US005711744A

United States Patent [19]

Strawcutter et al.

[11] Patent Number: 5,711,744

[45] Date of Patent: Jan. 27, 1998

[54] HELICAL TUBE RECREATIONAL COMPONENT

[75] Inventors: Grant M. Strawcutter; James O. Dunn, Jr.; Jonathan E. Brooks, all of Charlotte, N.C.

[73] Assignee: Soft Play, L.L.C, Charlotte, N.C.

[21] Appl. No.: 659,175

[22] Filed: Jun. 5, 1996

[51] Int. Cl.[6] ..... A63B 9/00

[52] U.S. Cl. ..... 482/35; D21/242; 482/36

[58] Field of Search ..... 482/35, 148; 285/184; 138/119, 120, 177

[56] References Cited

U.S. PATENT DOCUMENTS

| | | | |
|---|---|---|---|
| D. 291,717 | 9/1987 | Brooks | D21/242 |
| 1,630,588 | 5/1927 | Sperry | 138/120 |
| 2,823,703 | 2/1958 | Nusser | 138/120 |
| 3,565,226 | 2/1971 | Winchester | 183/12 |
| 3,755,878 | 9/1973 | Henning | 29/456 |
| 3,814,418 | 6/1974 | Henning | 272/56.5 |
| 3,895,796 | 7/1975 | Pestalozzi | 482/35 |
| 4,379,551 | 4/1983 | Ahrens | 272/56.5 |
| 4,384,594 | 5/1983 | Moritz | 138/120 |

FOREIGN PATENT DOCUMENTS

| | | | |
|---|---|---|---|
| 1403744 | 8/1975 | United Kingdom | 285/184 |

*Primary Examiner*—Richard J. Apley
*Assistant Examiner*—William LaMarca
*Attorney, Agent, or Firm*—Polster, Lieder, Woodruff and Lucchesi

[57] ABSTRACT

A one-piece helical tube component for use in forming spiral or helical playground units is disclosed. The helical tube component includes an interconnected series of helical tube segments each having a constant predetermined diameter and slope. Complementary male and female tube segments are provided adjacent opposite ends of the interconnected series of helical tube segments for corresponding mating engagement with complementary male and female tube segments of another similarly formed helical tube component.

11 Claims, 6 Drawing Sheets

HELICAL TUBE RECREATIONAL COMPONENT

BACKGROUND OF THE INVENTION

The present invention relates to a one-piece helical tube recreational component, and more specifically, to a one-piece helical tube component for use in forming spiral or helical playground units for children including spiral or helical slides, a horizontal corkscrew crawl, and other playground units.

At the present time, spiral or helical recreational slides for children are formed by a complex combination of cuts and rotations that are made in both 90° and straight plastic tube sections. This means that to form a particular spiral or helical slide, a plurality of plastic tube sections must be cut in a predetermined way, while allowing for different rotational positioning of adjacent tube sections, in order to create the spiral or helical slide that is desired. As will be appreciated, the complex combination of cuts and rotations in plastic tube sections requires customization of the cuts and rotations to provide a particular helical or spiral slide. This is time consuming and expensive, including both the product itself and the labor that is required.

In order to overcome the aforementioned customization requirements of the prior art, the present invention provides a one-piece hollow recreational tube component that is configured, arranged and dimensioned for interconnection with another similarly formed helical tube recreational component, in order to form various spiral or helical slides and other recreational playground units.

SUMMARY OF THE INVENTION

Among the several objects and advantages of the present invention include:

The provision of a one-piece helical tube component for use in forming spiral or helical playground units that overcomes the aforementioned problems of the prior art;

The provision of the aforementioned one-piece helical tube component that eliminates the customization of cuts and rotations currently required by prior art designs, while minimizing the number of individual parts and labor that is required;

The provision of the aforementioned one-piece helical tube component that is capable of being interconnected to another similarly formed helical tube component to form the desired helical or spiral slide or other recreational playground unit that is desired;

The provision of the aforementioned one-piece helical tube component having a constant predetermined diameter and slope in its formed construction;

The provision of the aforementioned one-piece helical tube component that is constructed in a clockwise or counterclockwise downward spiral configuration; and The provision of the aforementioned one-piece helical tube component which is rotationally molded as a one-piece plastic unit with inherent strength and durability; facilitates assembly and use; and is otherwise well adapted for the purposes intended.

Briefly stated, the one-piece helical tube component of the present invention is used in forming spiral or helical playground units for children. The helical tube component includes an interconnected series of helical tube segments each having a constant predetermined diameter and slope. Complementary male and female tube segments are provided adjacent opposite ends of the interconnected series of helical tube segments for corresponding mating engagement with complementary male and female tube segments of another similarly formed helical tube component.

The helical tube segments in the interconnected series are rotatively positioned or offset a constant predetermined number of degrees relative to an adjacent helical tube segment to provide the constant predetermined slope of the interconnected series of helical tube segment. Preferably, the constant predetermined number of degrees of the rotative positionment is 8°. Preferably also, the interconnected series of helical tube segments have a counterclockwise downward spiral slope.

Each helical tube segment in the interconnected series is preferably formed with the same predetermined configuration. This includes angularly offset cylindrical edge surfaces on each side of each helical tube segment that are interconnected during the molding process to adjacent angularly offset cylindrical edge surfaces of an adjacent helical tube segment.

At one end of the helical tube component, an intermediate helical tube segment is provided between the interconnected series of the helical tube segments and the female tube segment. The intermediate helical tube segment is provided with one angularly offset cylindrical edge surface that is connected to one end of the interconnected series of helical tube segments and a second cylindrical edge surface generally parallel to and interconnected to one of the cylindrical edge surfaces of the female tube segment.

The male tube segment at the other end of the helical tube component includes one angularly offset cylindrical edge surface that is interconnected to a second end of the interconnected series of helical tube segments and includes a second cylindrical edge surface at an outermost end that extends generally transverse to the male tube segment.

In order to form desired helical or spiral slides or other playground units for children, typically, a plurality of one-piece helical tube components must be interconnected to one another to form the desired playground unit.

These and other objects and advantages of the present invention will become apparent from the description that follows.

BRIEF DESCRIPTION OF THE DRAWINGS

In the drawings.

Corresponding reference numerals will be used throughout the several figures of the drawings.

DESCRIPTION OF THE PREFERRED EMBODIMENTS

The following detailed description illustrates the invention by way of example and not by way of limitation. This description will clearly enable one skilled in the art to make and use the invention, and describes several embodiments, adaptions, variations, alternatives and uses of the invention, including what I presently believe is the best mode of carrying out the invention.

Figure 1:
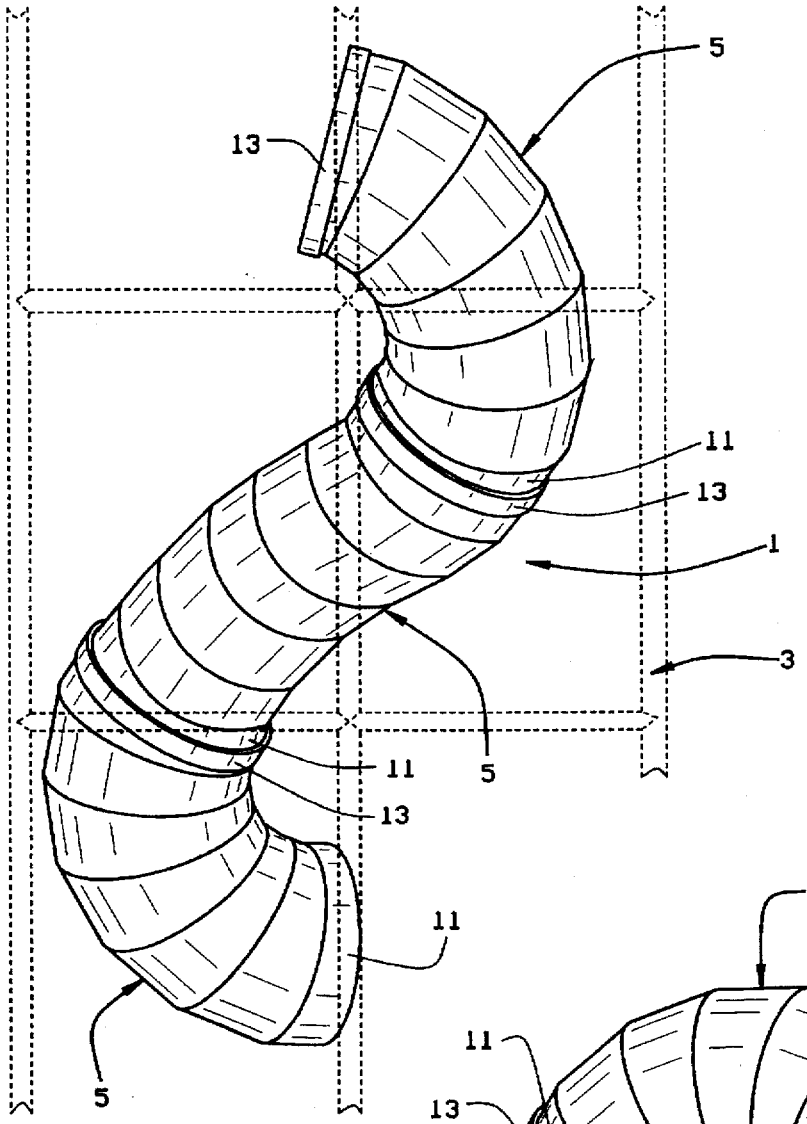
FIG. 1 is a perspective view of a series of helical tube components connected to one another to form a spiral or helical playground unit with a typical supporting structure shown in phantom lines.

The present invention is usefully employed, for example, in a spiral or helical slide 1 for children illustrated in FIG. 1 of the drawings. The spiral or helical slide is supported by the supporting structure 3 illustrated in phantom lines. Typically, the supporting structure 3 includes a series of vertical and transverse struts that are interconnected for supporting the spiral or helical slide 1 through various saddles or other interconnecting devices (not shown). Other fastening techniques may be employed for supporting and securing the spiral or helical slide 1, as will be apparent.

In additional to spiral or helical slides, other types of playground units including a horizontal corkscrew crawl or other types of playground units may also be usefully constructed in accordance with the teachings of the present invention.

Figure 2:
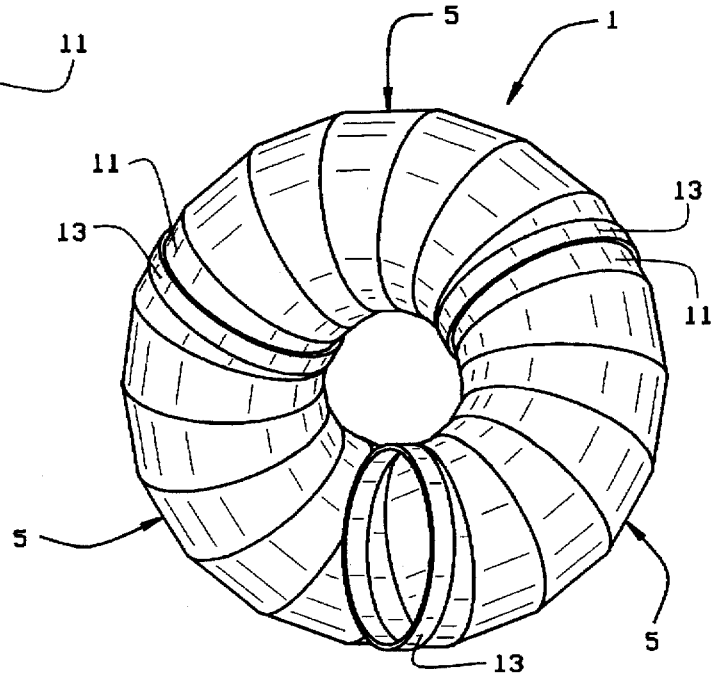
FIG. 2 is a top plan view of the series of interconnected helical tube recreational components shown in FIG. 1.
Figure 3:
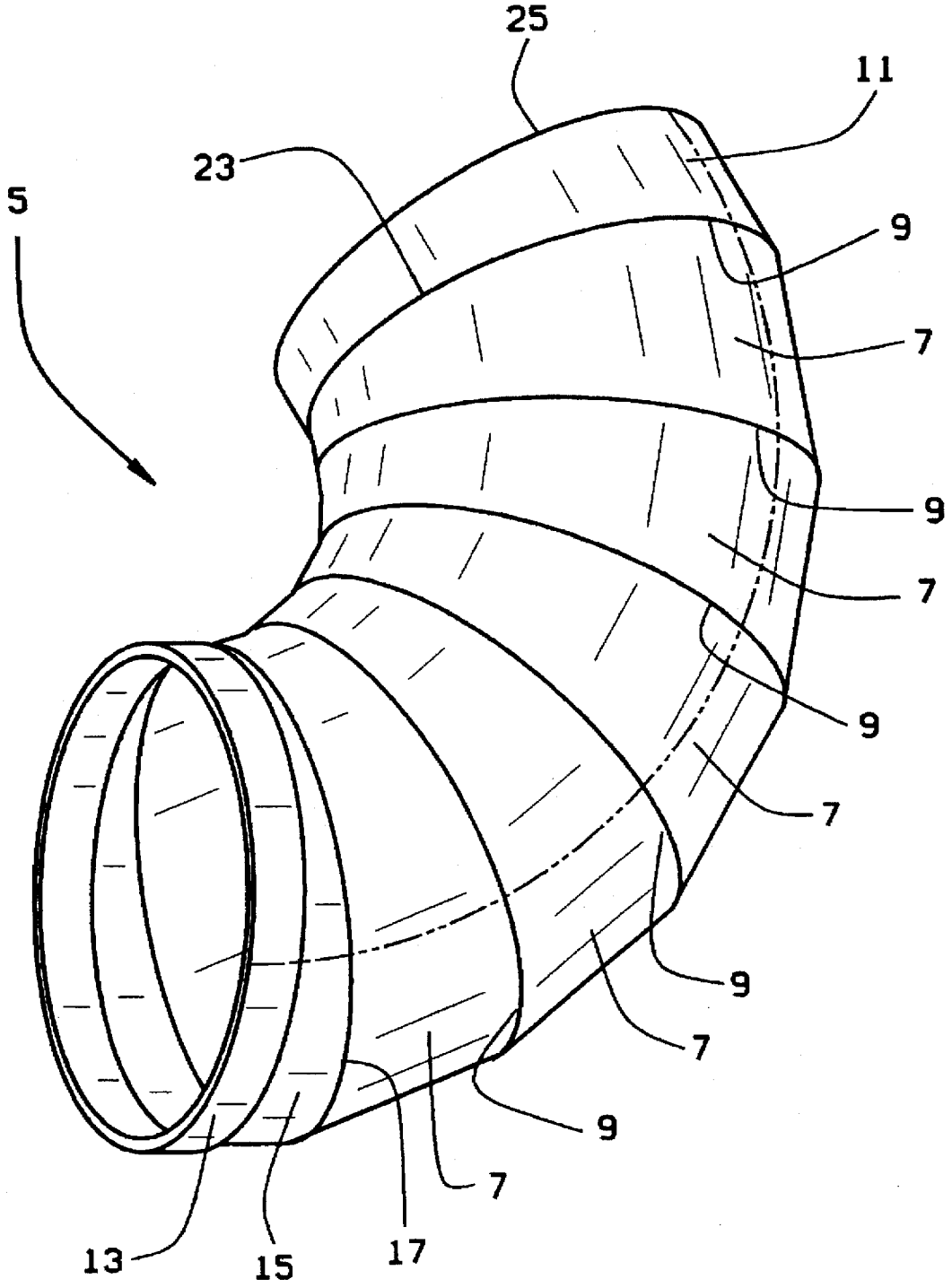
FIG. 3 is a perspective view of one helical tube recreational component constructed in accordance with the teachings of present invention.
Figure 4:
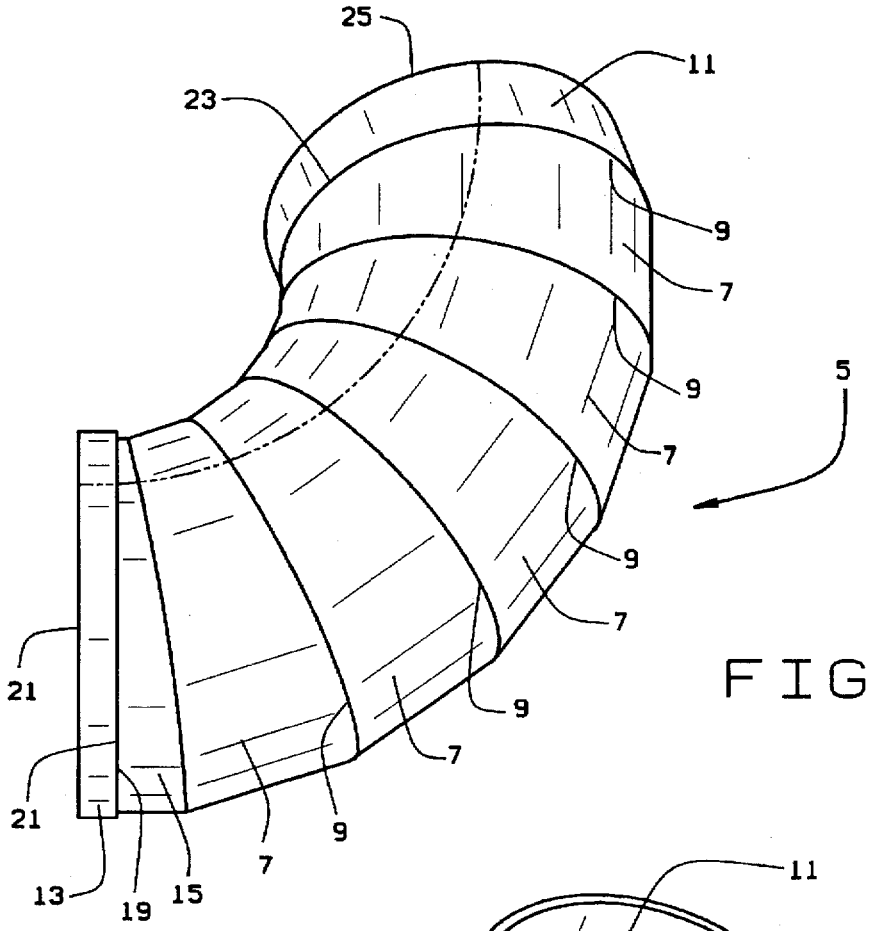
FIG. 4 is a top plan view of the helical tube recreational component.

In forming such spiral or helical playground units for children, a plurality of helical tube recreational components 5 are interconnected to one another in the manner illustrated, for example, in FIGS. 1–2 of the drawings. Each of the helical tube recreational components 5 are similarly constructed. Thus, it is relatively easy to position and assemble the identically formed helical tube recreational components 5 to one another, as will be apparent from the FIGS. 1–2 illustrations.

For the specific construction of the helical tube recreational component 5, reference is made to FIGS. 3–13 of the drawings. Each helical tube recreational component 5 is a one-piece rotationally molded plastic element that is formed from a suitable thermoplastic material such as polyethylene. When formed in the manner illustrated in FIG. 3–9 of the drawings, the one-piece helical tube component 5 provides the necessary strength and durability to enable children to safely pass or slide through the component in the playground unit that is formed.

Each one-piece helical tube component 5 includes an interconnected series of helical tube segments 7 having a constant predetermined diameter (same inside and outside diameter) and slope. As illustrated in FIGS. 3–9 of the drawings, there are five helical tube segments 7 forming the interconnected series of helical tube segments in the helical tube component 5. Of course, more or less helical tube segments 7 may be used, if desired.

Figure 10:
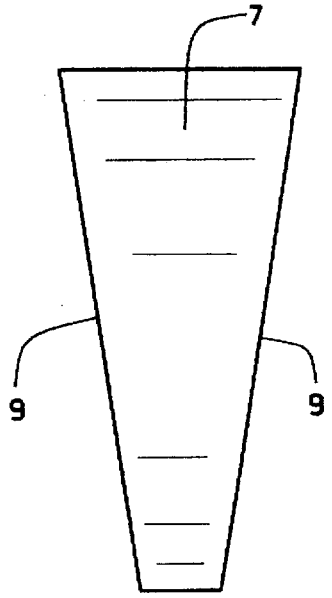
FIG. 10 is a fragmentary side elevational view of one of the helical tube segments used in forming the helical tube recreational component.
Figure 11:
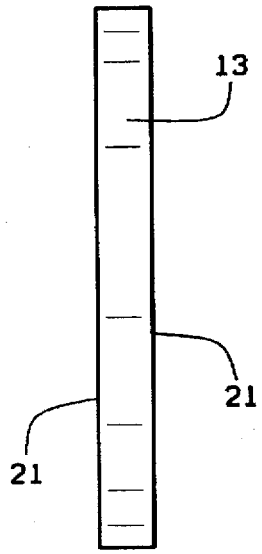
FIG. 11 is a side elevational view of the female tube segment provided at one end of the helical tube recreational component.
Figure 12:
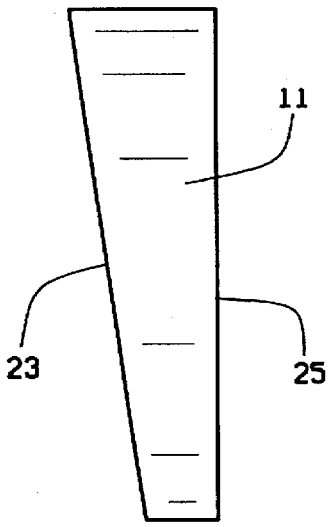
FIG. 12 is a side elevation view of the male tube segment provided at an opposite end of the helical tube recreational component.
Figure 13:
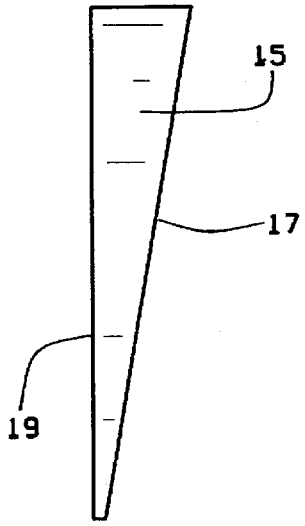
FIG. 13 is a side elevational view of an intermediate tube segment provided adjacent the male tube segment at one end of the helical tube recreational component.

Each helical tube segment 7 has the same predetermined configuration and includes a band or ring with angularly offset cylindrical edge surfaces 9, 9, as shown in the individual helical tube segment 7 shown in FIG. 10 of the drawings. Of course, it will understood that during the molding process, the spaced angularly offset cylindrical edge surfaces 9, 9 are interconnected to adjacent angularly offset cylindrical edge surfaces 9, 9 of adjacent helical tube segments 7 in the interconnected series of helical tube segments 7.

Complementary male and female tube segments 11, 13 are provided adjacent opposite ends of the interconnected series of helical tube segments 7 for corresponding mating engagement with complementary male and female tube segments 11, 13 of another similarly formed helical tube component 5, as illustrated in FIGS. 1–2. The male tube segment 11 has the same constant predetermined diameter (both inside and outside diameter dimensions) as the helical tube segments 7 of the interconnected series; however, the female tube segment 13 is slightly larger in order to matingly receive the male tube segment 11 of another similarly formed helical tube component 5.

At one end of the helical tube component 5, an intermediate helical tube segment 15 is provided between the interconnected series of helical tube segments 7 and the female tube segment 13. The intermediate helical tube segment 15, individually shown in FIG. 13 of the drawings, has one angularly offset cylindrical edge surface 17 which in interconnected to one angularly offset cylindrical edge surface 9 of the lowermost helical tube segment 7 in the interconnected series, as shown in FIGS. 3–9 of the drawings. Also shown in these figures is a second cylindrical edge surface 19 that is generally parallel to and interconnected to one of the cylindrical edge surfaces 21 of the female tube segment 13. The male tube segment 11, as best shown in the individual element illustrated in FIG. 12 of the drawings, includes one angularly offset cylindrical edge surface 23 that is interconnected to a second end of the interconnected series of helical tube segments 7, along one of the angularly offset cylindrical edge surfaces 9. The male tube segment further includes a second cylindrical edge surface 25 at an outermost end of the male tube segment 11 that extends generally transverse to the male tube segment 11, to facilitate mating engagement with the female tube segment 13.

Figure 5:
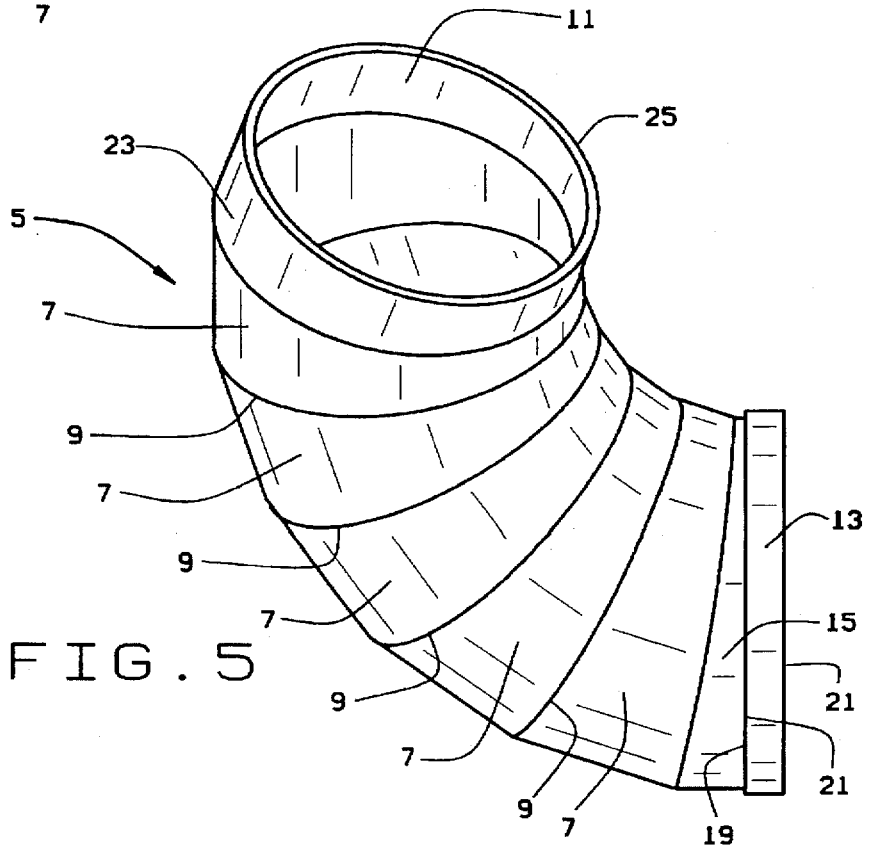
FIG. 5 is a bottom plan view of the helical tube recreational component.
Figure 6:
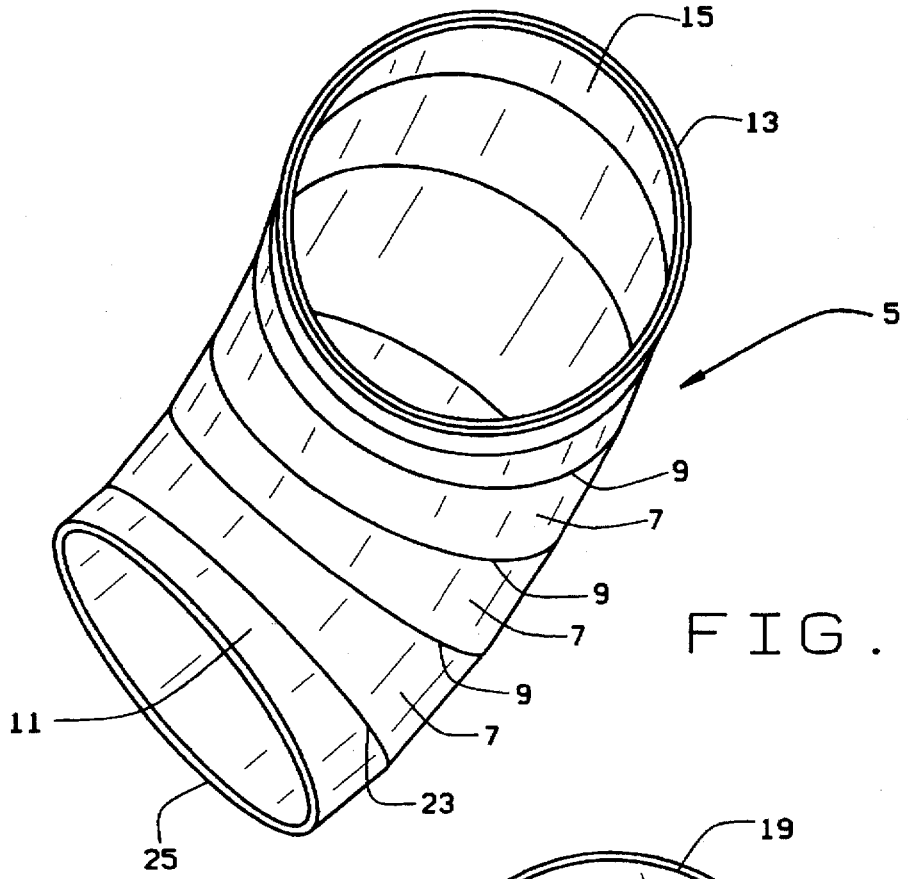
FIG. 6 is a left end elevational view of the helical tube recreational component.
Figure 7:
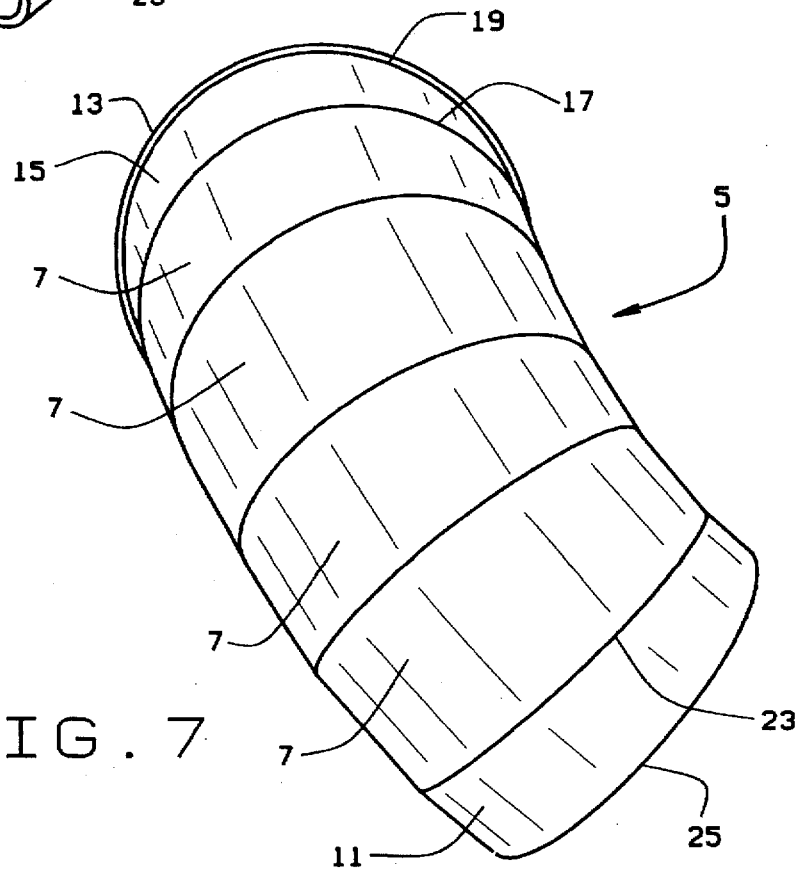
FIG. 7 is a right end elevational view of the helical tube recreational component.
Figure 8:
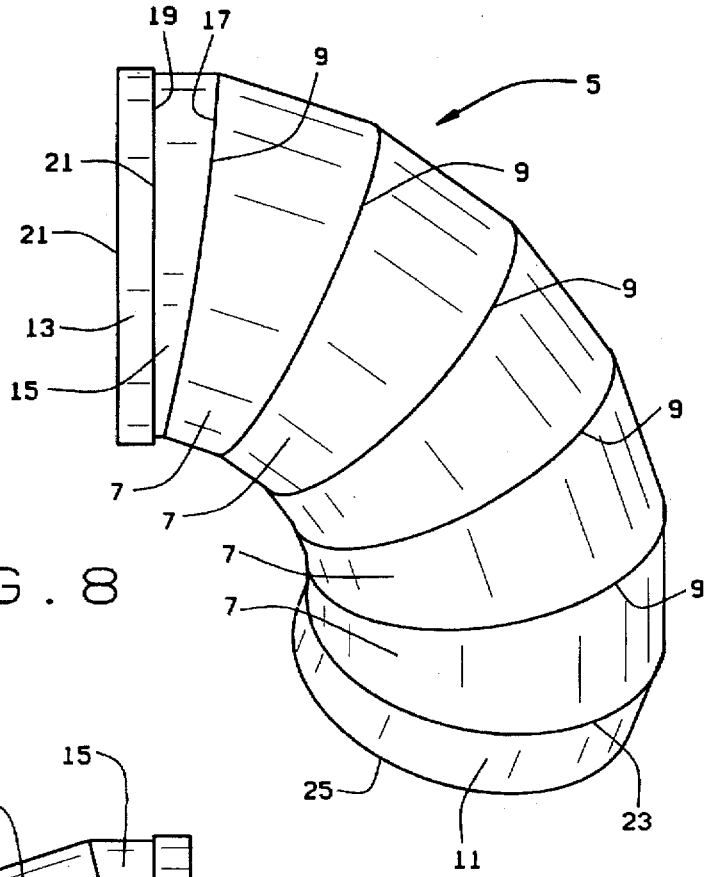
FIG. 8 is a front elevational view of the helical tube recreational component.
Figure 9:
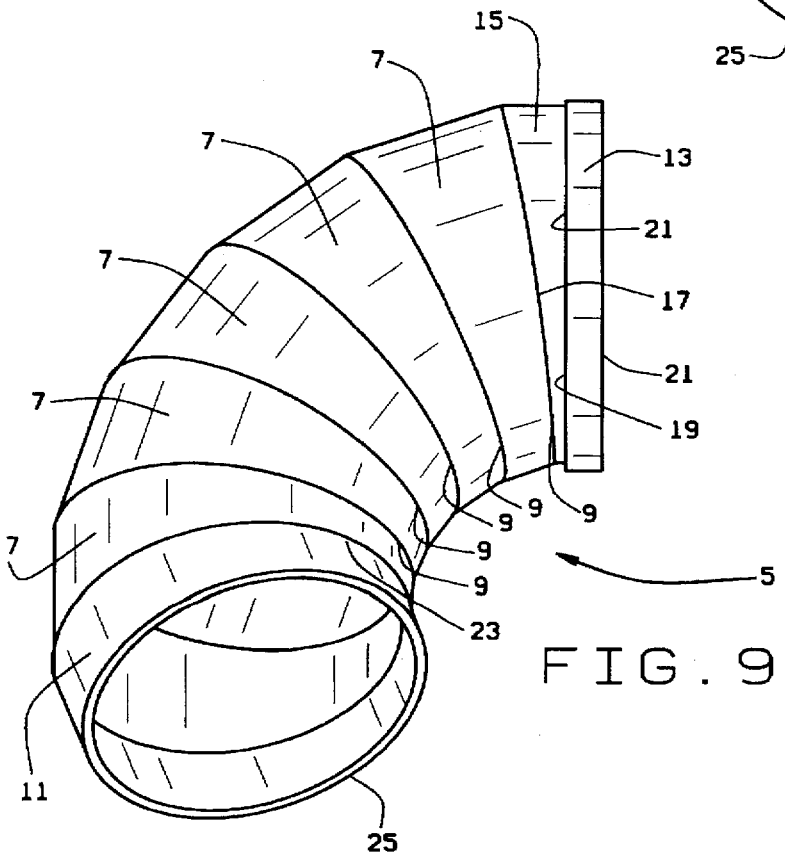
FIG. 9 is a rear elevational view of the helical tube recreational component.

As will be appreciated, each of the cylindrical edge surfaces 9 of the helical tube segments 7 as well as the cylindrical edge surfaces 17, 19 of the intermediate helical tube segment 15, one cylindrical edge surface 21 of the female tube segment 13 and the cylindrical edge surface 23 of the male tube segment 11 are generally longitudinally aligned in that they all lie within the same plane or are co-planer with the adjacent cylindrical edge surface of an adjacent helical segment. That is, during the rotational molding process, each of the cylindrical edge surfaces described above are actually integrally connected to and become part of the various helical tube segments forming the helical tube component 5, as will be understood. This provides a smooth interior sliding surface for each one-piece helical tube component as best seen in FIGS. 5–6 and 9 of the drawings.

In order to obtain the desired spiral or helical slope for the helical tube component 5 (shown in the drawings to be a counterclockwise downward spiral slope), each of the helical tube segments 7 in the interconnected series of helical tube segments 7 are rotatively positioned or offset from an adjacent helical tube segment by a constant predetermined number of degrees. The same is true for the male tube segment 11 which is rotatively positioned or offset from its interconnected helical tube segment 7 and the intermediate helical tube segment 15 that interconnects an outermost end of one of the helical tube segments 7 with the female tube segment 13. Each of the aforementioned helical tube segments are rotatively positioned or offset from an adjacent helical tube segment by a constant predetermined number of degrees. For illustrative purposes, the constant predetermined number of degrees shown in the drawings is 8°, although this can be varied, as desired. It will be noted; however, that there is no rotative positionment or offset of the female tube segment 13 relative to the intermediate helical tube segment 15. This assures common mating surfaces between the male and female tube segment 11, 13, as will be understood.

By maintaining a constant predetermined diameter and slope for all of the helical tube segments except the female tube segment 13, which must be larger and have no slope for common mating engagement with the male tube segment 11, each of the interconnected series of helical tube segments 7, the male tube segment 11 and the intermediate tube segment 15 are provided with a constant predetermined diameter and slope that produce the desired downward spiral slope for the helical tube component 5, without providing individual tubes that are cut and rotated in customized complex combinations, as in the prior art.

From the foregoing, it will now be appreciated that the helical tube component of the present invention, because it is manufactured with the desired predetermined constant diameter and slope, greatly facilitates the assembly of similarly formed helical tube components, while overcoming the problems associated with the prior art. A variety of different types of spiral or helical slides, horizontal corkscrew crawl units or other playground units may be formed by assembling a plurality of helical tube components in a desired arrangement. At the same time, the plurality of assembled or interconnected similarly formed helical tube components provides a strong, durable and safe playground unit for the enjoyment of children.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

We claim:

1. A one-piece helical tube component for use in forming spiral or helical playground units, comprising:

the one-piece helical tube component including an interconnected series of integrally molded helical tube segments each having a constant predetermined inner and outer diameter and a constant predetermined helical slope, adjacent helical tube segments being rotatively offset from each other by a constant predetermined number of degrees to provide a continuing interconnected series of integrally molded substantially diametrical similar helical tube segments of progressively increasing helical slope from one end of the one-piece helical tube component to an opposite end;

opposite ends of each helical tube segment having a cylindrical edge surface each of which is longitudinally aligned with the cylindrical edge surface of an adjacent substantially diametrically similar helical tube segment in order to provide a substantially smooth interior sliding surface for the one-piece helical component; and complementary male and female tube segments adjacent opposite ends of the interconnected series of integrally molded helical tube segments for corresponding mating engagement with complementary male and female tube segments of another similarly formed helical tube component.

2. The helical tube component as defined in claim 1 in which the constant predetermined number of degrees is 8°.

3. The helical tube component as defined claim 1 in which the interconnected series of helical tube segments have a counterclockwise downward spiral slope.

4. The helical tube component as defined in claim 1 in which each helical tube segment in the interconnected series has the same predetermined configuration.

5. The helical tube component as defined in claim 4 in which each helical tube segment has angularly offset cylindrical edge surfaces.

6. The helical tube component as defined in claim 5 including an intermediate helical tube segment between the interconnected series of helical tube segments and the female tube segment, the intermediate helical tube segment having one angularly offset cylindrical edge surface interconnected to one end of the interconnected series of helical tube segments and a second cylindrical edge surface generally parallel to cylindrical edge surfaces of the female tube segment.

7. The helical tube component as defined in claim 6 in which the male tube segment includes one angularly offset cylindrical edge surface that is interconnected to a second edge surface that is interconnected to a second end of the interconnected series of helical tube segments and a second cylindrical edge surface that extends generally transverse to the male tube segment.

8. The helical tube component as defined in claim 1 which is joined to a corresponding helical tube component to form a desired playground unit.

9. A one piece helical tube component for use in forming spiral or helical playground units, comprising:

each one-piece helical tube component including an interconnected series of integrally molded helical tube segments each having the same predetermined confirmation with angularly offset cylindrical edge surfaces that abut angularly offset cylindrical edge surfaces of adjacent integrally molded helical tube segments;

each helical tube segment having a constant predetermined inner and outer diameter and a constant predetermined helical slope including being rotatively offset from an adjacent helical tube segment by a constant predetermined number of degrees, the interconnected series of integrally molded helical tube segments being substantially diametrically similar and having a progressively increasing spiral slope from one end of the one-piece helical tube component to an opposite end;

opposite ends of each helical tube segment having a cylindrical edge surface each of which is longitudinally aligned with the cylindrical edge surface of an adjacent substantially diametrically similar helical tube segment in order to provide a substantially smooth interior sliding surface for the one-piece helical component; and complementary male and female tube segments adjacent opposite ends of the interconnected series of the integrally molded helical tube segments for corresponding mating engagement with complementary male and female tube segments of another similarly formed helical tube component.

10. The helical tube component as defined in claim 9 including a plurality of helical tube components connected together for form a spiral of helical playground unit.

11. A plurality of one-piece helical tube components joined together to form a spiral or helical playground unit, each helical tube component comprising:

an interconnected series of integrally molded helical tube segments each having a constant predetermined inner and outer diameter and a constant predetermined helical slope including being rotatively offset from an adjacent helical tube segment by a constant predetermined number of degrees to provide each one piece helical tube component with a progressively increasing helical slope from one end to an opposite end, and complementary male and female tube segments adjacent opposite ends of the interconnected series of integrally molded helical tube segments;

opposite ends of each helical tube segment having a cylindrical edge surface each of which is longitudinally aligned with the cylindrical edge surface on an adjacent substantially diametrically similar helical tube segment in order to provide a substantially smooth interior sliding surface for the one-piece helical component; and the plurality of one-piece helical tube components being joined by corresponding mating engagement with the complementary male and female tube segments of the plurality of one-piece helical tube components.

* * * * *